US009752431B2

(12) United States Patent
Bullock et al.

(10) Patent No.: US 9,752,431 B2
(45) Date of Patent: Sep. 5, 2017

(54) APPARATUS AND METHOD FOR OBTAINING FORMATION FLUID SAMPLES UTILIZING A SAMPLE CLEAN-UP DEVICE

(71) Applicants: Wade Bullock, Montgomery, TX (US); James T. Cernosek, Missouri City, TX (US)

(72) Inventors: Wade Bullock, Montgomery, TX (US); James T. Cernosek, Missouri City, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 566 days.

(21) Appl. No.: 13/739,811

(22) Filed: Jan. 11, 2013

(65) Prior Publication Data

US 2014/0196532 A1 Jul. 17, 2014

(51) Int. Cl.
*E21B 49/08* (2006.01)
*E21B 49/10* (2006.01)

(52) U.S. Cl.
CPC ..... *E21B 49/08* (2013.01); *E21B 49/10* (2013.01)

(58) Field of Classification Search
CPC ..... E21B 49/08; E21B 49/10
See application file for complete search history.

(56) References Cited

U.S. PATENT DOCUMENTS 2,747,401 A * 5/1956 Henri-Georges ..... 73/152.05
3,352,361 A * 11/1967 Urbanosky ..... 166/100
3,611,799 A * 10/1971 Davis ..... 73/152.24
4,742,459 A * 5/1988 Lasseter ..... 702/12
6,092,416 A 7/2000 Halford et al.
6,212,948 B1 4/2001 Ekdahl et al.
6,301,959 B1 * 10/2001 Hrametz et al. ..... 73/152.23
6,435,279 B1 * 8/2002 Howe ..... E21B 49/086 166/336
6,467,544 B1 * 10/2002 Brown ..... E21B 49/082 166/167
6,499,344 B2 12/2002 Nelson et al.
6,659,177 B2 * 12/2003 Bolze ..... E21B 49/082 166/167
7,243,536 B2 * 7/2007 Bolze ..... E21B 49/081 166/264
7,458,252 B2 * 12/2008 Freemark et al. ..... 73/64.45
(Continued)

OTHER PUBLICATIONS

PCT International Search Report and Written Opinion; International Application No. PCT/US2014/010871; International Filing Date: Jan. 9, 2014; Date of Mailing: Apr. 25, 2014; pp. 1-12.

*Primary Examiner* — John Fitzgerald
(74) *Attorney, Agent, or Firm* — Cantor Colburn LLP

(57) ABSTRACT

In one aspect, a method of obtaining a fluid from a formation is disclosed that in one embodiment may include: pumping fluid received by a first probe from the formation into the wellbore; pumping fluid received by a second probe from the formation into the wellbore; determining when the fluid received by one of the first and second probes is clean; and pumping the fluid received by the first probe into a sample chamber while collecting the formation fluid received by the second probe from the formation into a storage chamber having an internal pressure less than the pressure of the formation.

11 Claims, 6 Drawing Sheets

(56) References Cited

U.S. PATENT DOCUMENTS

| | | | | |
|---|---|---|---|---|
| 7,857,049 | B2 * | 12/2010 | Sherwood | E21B 49/10 166/100 |
| 7,886,825 | B2 * | 2/2011 | Van Hal et al. | 166/302 |
| 8,899,323 | B2 * | 12/2014 | Zazovsky | E21B 49/10 166/100 |
| 9,068,436 | B2 * | 6/2015 | Theron | E21B 27/00 |
| 9,284,838 | B2 * | 3/2016 | Cernosek | E21B 49/08 |
| 9,322,267 | B2 * | 4/2016 | Pop | E21B 49/082 |
| 2004/0020649 | A1 | 2/2004 | Fields | |
| 2004/0221983 | A1 * | 11/2004 | Ma et al. | 166/100 |
| 2005/0115716 | A1 | 6/2005 | Ciglenec et al. | |
| 2005/0150287 | A1 * | 7/2005 | Carnegie | E21B 49/081 73/152.28 |
| 2006/0042793 | A1 | 3/2006 | Del Campo et al. | |
| 2006/0101905 | A1 * | 5/2006 | Bittleston et al. | 73/152.24 |
| 2008/0041593 | A1 * | 2/2008 | Brown | E21B 36/001 166/302 |
| 2008/0073078 | A1 | 3/2008 | Sherwood | |
| 2009/0101339 | A1 * | 4/2009 | Zazovsky et al. | 166/250.01 |
| 2010/0223990 | A1 | 9/2010 | Simpson et al. | |
| 2011/0185809 | A1 | 8/2011 | Guieze et al. | |
| 2012/0132419 | A1 | 5/2012 | Zazovsky et al. | |
| 2013/0081803 | A1 * | 4/2013 | Tao | E21B 17/1014 166/247 |
| 2013/0213645 | A1 * | 8/2013 | Proett et al. | 166/250.17 |
| 2014/0166269 | A1 * | 6/2014 | Pop | E21B 49/10 166/250.01 |

* cited by examiner

APPARATUS AND METHOD FOR OBTAINING FORMATION FLUID SAMPLES UTILIZING A SAMPLE CLEAN-UP DEVICE

BACKGROUND OF THE DISCLOSURE

1. Field of the Disclosure

The present disclosure relates generally to apparatus and methods for formation fluid collection and testing.

2. Description of the Related Art

During both drilling of a wellbore and after drilling, clean fluid from the formation is often extracted to determine the nature of the hydrocarbons in hydrocarbon-bearing formations. Fluid samples are often collected in sample chambers and the collected samples are tested to determine various properties of the extracted formation fluid. To drill a well, drilling fluid is circulated under pressure greater than the pressure of the formation in which the well is drilled. The drilling fluid invades into the formation surrounding the wellbore to varying depths, referred to as the invaded zone, which contaminates the original fluid present in the invaded zone. To collect samples of the original fluid present in the formation, a formation testing tool is conveyed into the wellbore. A pump typically extracts the fluid from the formation via a sealed probe placed against the inside wall of the wellbore. The initially extracted fluid is discarded into the wellbore while testing it for contamination. When the extracted fluid is sufficiently clean, samples are collected in chambers for further analysis. Single and concentric probes have been proposed for extracting formation fluid. In concentric probes, separate pumps are used to extract fluid from the formation via an outer probe and an inner probe. The outer probe extracts the fluid present around the inner probe, which aids in removing the contaminated fluid more efficiently and may prevent fluid from the wellbore to flow into the inner probe. When the contamination is at an acceptable level, the fluid from the inner probe is pumped into sample chambers (also referred to as "sampling"), while the fluid from the outer probe is discharged into the wellbore. During drawdown, the pump used for the outer probe creates pressure kick-backs in the inner probe, which reduces efficiency of the collection of the fluid samples. Also, since one pump is used for sampling the process of collecting samples can take long time.

The disclosure herein provides a formation evaluation system with a fluid extraction system that utilizes two or more probes that addresses some of the above-noted discrepancies.

SUMMARY

In one aspect, a method of obtaining a fluid from a formation is disclosed that in one embodiment may include: pumping fluid received by a first probe and a second probe from the formation into the wellbore; determining when the fluid received by one of the first and second probes is clean; and pumping the fluid received by the first probe into a sample chamber while collecting the formation fluid received by the second probe from the formation into a storage device having an internal pressure less than the pressure of the formation.

In another aspect, an apparatus for obtaining a fluid from a formation is disclosed that in one embodiment may include: a first probe and a second probe; a first pump for extracting the fluid from the formation via the first probe and a second pump for extracting the fluid from the formation via the second probe; a first flow control device for directing the fluid extracted via the first probe into the wellbore and a sample chamber; a storage device for receiving the fluid extracted via the second probe due to pressure differential between the formation pressure and the pressure in the storage device; and a second flow control device for selectively directing the fluid extracted via the second probe into the wellbore and storage device.

Examples of certain features of the apparatus and methods disclosed herein are summarized rather broadly in order that the detailed description thereof that follows may be better understood. There are, of course, additional features of the apparatus and methods disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, wherein.

DESCRIPTION OF THE FIGURES

Figure 1:
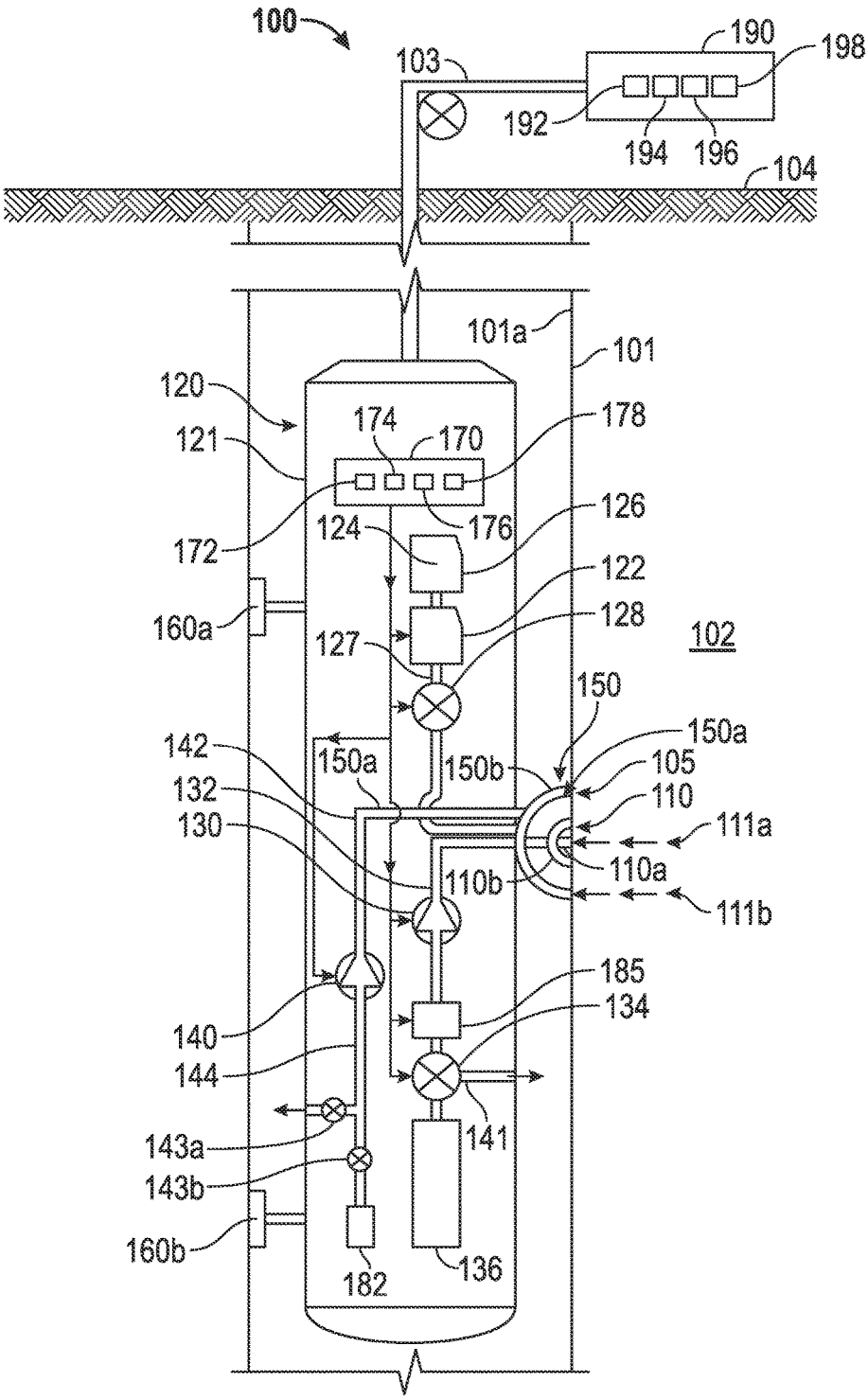
FIG. 1 is a schematic diagram of an exemplary formation evaluation system for obtaining formation fluid samples, according to one embodiment of the disclosure.

FIG. 1 is a schematic diagram of an exemplary formation evaluation system 100 for obtaining formation fluid samples and retrieving such samples for determining one or more properties of such fluid. The system 100 is shown to include a downhole formation evaluation tool 120 deployed in a wellbore 101 formed in a formation 102. The tool 120 is shown conveyed by a conveying member 103, such as a wireline, coiled tubing or a drilling tubular, from a surface location 104. In one embodiment, the tool 120 includes a fluid extraction or fluid withdrawal device 105 that includes an inner probe 110 and an outer probe 150. In one embodiment, probes 110 and 150 are concentric, as shown in FIG. 1. Probe 110 includes a fluid conduit or line 110*a* and a seal pad 110*b* around the conduit 110*a*. The outer probe 150 includes a conduit or fluid line 150*a* and a seal pad 150*b* around the conduit 150*b*. In one configuration, probes 110 and 150 may be extended from a tool body 121 radially outward toward wellbore wall 101*a*. A pump 122 supplies a fluid 124 under pressure from a fluid chamber 126 to probes 110 and 150 via a fluid line 127 to extend and urge probes 110 and 150 against the inside wall 101*a* of the wellbore 101. Pads 160*a* and 160*b* on the opposite side of the fluid withdrawal device 105 are extended so that the probes 110 and 150, when extended, will urge against the wellbore wall 101*a*. A flow control device 128, such as a valve, associated with or in line 127 may be provided to control the flow of the fluid 124 to the probes 110 and 150. In the configuration of FIG. 1, a common fluid 124 and a common hydraulic line 127 are utilized for extending probes 110 and 150. Separate pumps and supply lines may also be utilized.

A pump 130 is coupled to the inner probe 110 via a fluid line 132 for withdrawing fluid 111*a* from formation 102. To draw fluid 111*a* from formation 102, the pump 130 is activated and the fluid withdrawn may be pumped into a chamber 136 via a flow control device 134. Alternatively, the withdrawn fluid may be discharged into the wellbore 101 via a fluid line 141. A pump 140 is coupled to the outer probe 150 via a fluid line 142 for withdrawing fluid 111*b* from formation 102. To draw fluid 111*b* from formation 102, the pump 140 is activated and in one aspect, the fluid withdrawn may be discharged into the wellbore via a conduit 144 and in another aspect collected in a clean-up unit 182 via a flow control device 143*b*. The clean-up device and/or sample chamber 136 may be disposed uphole or downhole of the probes 110 and 150.

The tool 120 further includes a controller 170 that contains circuits 172 for use in operating various components of the tool 120, a processor 174, such as a microprocessor, a storage device 176, such as a solid state memory, and programs 178 accessible to the processor 174 for executing instruction contained therein. The system 100 also includes a controller 190 at the surface that contains circuits 192, a processor 194, storage device 196 and programs 198.

To obtain clean formation fluid samples, the tool 120 is conveyed and placed at a selected depth in the wellbore 101. Pads 160*a* and 160*b* are activated to contact the wellbore wall 101*a*. The inner probe 110 and outer probe 150 are activated to urge against the wellbore wall 101*a* to seal the probes 110 and 150 against the wellbore wall 101*a*. In one aspect, both the inner and outer probes 110 and 150 are activated simultaneously or substantially simultaneously. Pumps 130 and 140 are activated to draw the formation fluid into their respective probes. Activating pump 140 causes the fluid 111*b* around the probe 110 to flow into the outer probe 150, while activating pump 130 causes the fluid 111*a* to flow into the inner probe 110. The initial fluid (111*a* and 111*b*) is the fluid present in the invaded zone and is thus contaminated. A fluid evaluation or testing device 185 may be used to determine when the fluid being withdrawn is sufficiently clean so that fluid samples may be collected. Any device, including, but not limited to, optical devices, may be utilized for determining contamination in the withdrawn fluid. As long as the fluid being withdrawn is contaminated above a threshold or otherwise not satisfactory, it may be discharged into the wellbore 101 via fluid lines 141 and 144. Once the fluid is clean, the valve 134 is operated to allow the fluid 111*a* from the inner probe 110 to enter the sample chamber 136. Such a mechanism allows for faster clean-up and prevents fluid from the wellbore to flow into the inner probe 110. In one aspect, when fluid 111*a* is being collected or prior thereto, pump 140 is deactivated and fluid 111*b* from the outer probe 150 is collected in the clean-up unit 180 due to pressure differential between the formation pressure and pressure in the clean-up unit 141. The pumps and flow control devices in the tool 120 may be controlled by the controller 170 according to instructions stored in programs 178 and/or instructions provided by the surface controller 190. Alternatively, controller 190 may control the operation of one or more devices in the tool 120 according to instructions provided by programs 198. The components of the formation evaluation tool 105 and methods for collecting clean formation fluid are described in more detail in reference to FIGS. 2-6.

Figure 2:
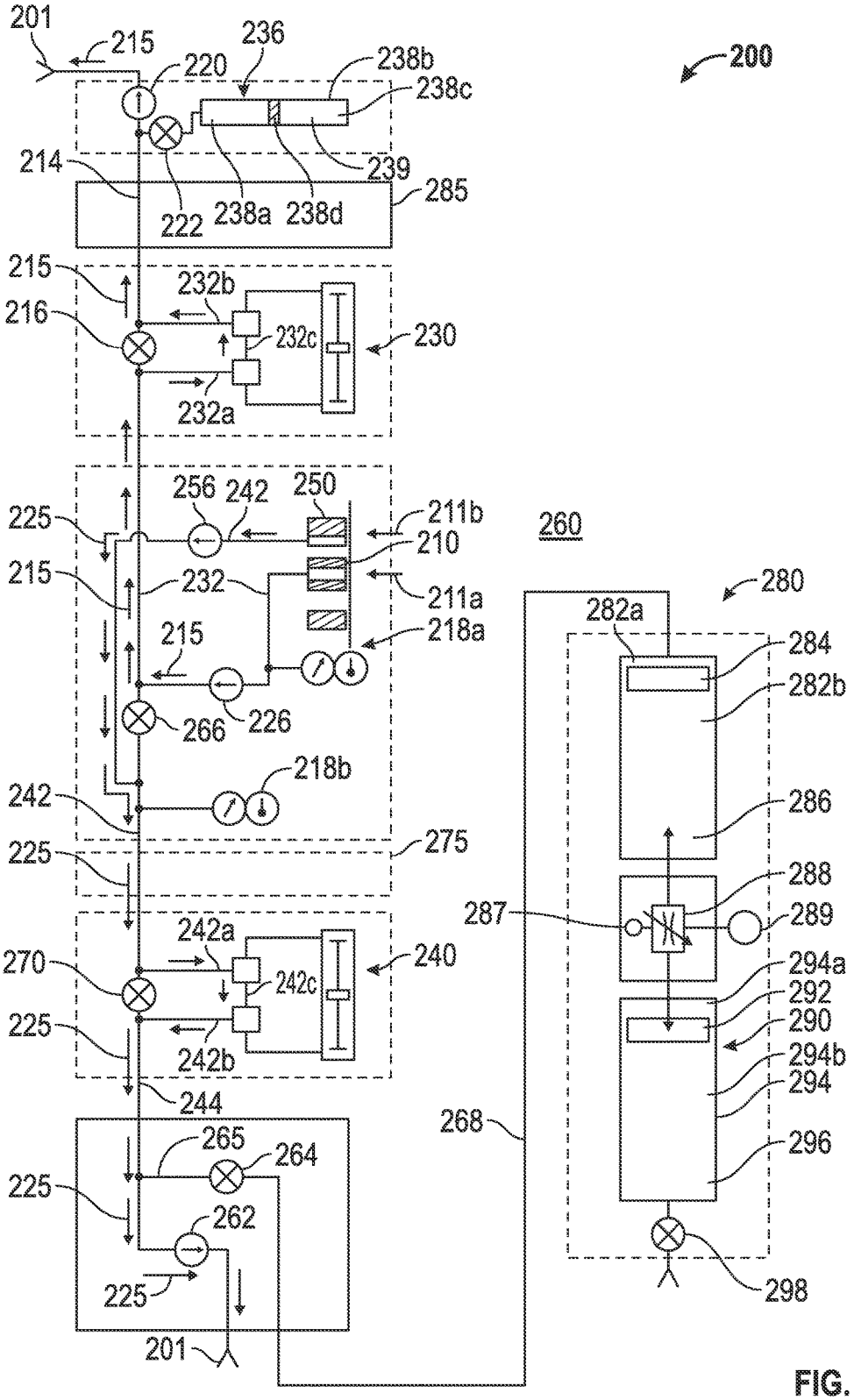
FIG. 2 is a line diagram of a formation evaluation tool that includes an inner probe and an outer probe showing fluid flow paths for pumping formation fluid obtained from the inner and outer probes into the wellbore.

FIG. 2 is a line diagram of a formation evaluation tool 200, according to one embodiment of the disclosure. The tool 200 includes an inner probe 210 and an outer probe 250. In the particular embodiment of tool 200, probes 210 and 250 are concentric with the probe 250 surrounding probe 210. A pump 230 extracts formation fluid 211*a* from the formation 260 into a fluid line 232 and a pump 240 extracts formation fluid 211*b* present around the outer probe 250 into a fluid line 242. Pump 230 is shown to draw the fluid 211*a* from line 232 via line 232*a*, connection line 232*c* and line 232*b* into line 214. A flow control device 220 may be selectively controlled by downhole controller 170 and/or surface controller 190 to discharge the formation fluid 211*a* from line 214 into the wellbore 201. A flow control device 222 is provided to enable the fluid 211*a* into a sample chamber 236. In one aspect, the sample chamber 236 includes a storage chamber 238*a* for collecting the formation fluid from line 214 and a force application device 238*b* for causing the storage chamber 238*a* to receive the formation fluid 211*a* against a selected pressure to maintain the fluid in chamber 238*a* above the formation fluid bubble point. In one aspect, the force application device 238*b* may include a chamber 238*c* with a pressurized gas 239 that applies pressure or force on a piston 238*d* in chamber 238*a*. In another aspect, chamber 238*c* may be opened to hydrostatic pressure so that chamber 238*a* receives the formation fluid against the hydrostatic pressure. A fluid identification device 285 associated with or placed in line 214 provides measurements for determining when the formation fluid 111*a* extracted by probe 210 is clean. For the purpose of this disclosure, the term "clean" means when the contamination, such as mud, present in the extracted fluid is at an acceptable level or meets a threshold.

Pump 240 extracts the formation fluid 211*b* from the formation 260 into fluid line 242. Pump 240 is shown to draw fluid 211*b* from line 242 via line connections 242*a*, 242*c* and 242*b* into line 244. The fluid in line 244 extracted via probe 250 may be selectively discharged into the wellbore 201 or into a sample clean-up unit or device 280. In one embodiment, a flow control device 262 controls the discharge of the fluid in line into the wellbore 201 and a flow control device 264 in line 265 connected to line 244 controls the discharge the fluid in line 244 to the sample clean-up unit 280. When the flow control device 262 is open and the flow control device 264 is closed, the fluid from line 244 discharges into the wellbore 201. When the flow control device 262 is closed and the flow control device 264 is open, the fluid from line 244 discharges into the sample clean-up unit 280 via line 268. A flow control device 270 between lines 242 and 244 allows the fluid in line 242 to pass into line 244. Thus, in the particular configuration of FIG. 2, when the flow control devices 220 and 264 and 266 are open and the flow control devices 216, 222, 262 and 270 are closed, the fluid from line 268 and thus the sample clean-up unit 280 is in fluid communication with the wellbore 201 via pumps 230 and 240. In such a configuration, the fluid from the sample clean-up unit 280 may be discharged into the wellbore 201. Any other fluid path may also be provided to discharge fluid from the sample clean-up unit 280 into the wellbore 201. A pressure sensor, flow sensor, viscosity sensor and other suitable sensors (collectively denoted by

218*a*) may be utilized to determine pressure, temperature, viscosity etc. of the fluid flowing into probes 110 and 150. Similar or other sensors may also be utilized at other places, such as sensors 218*b* shown in FIG. 2. Additionally, a sensor 287 may be utilized to determine, pressure, flow rate etc. The controller 170 and/or 190 as an operator at the surface may utilize such measurements to control the device 288 to control the flow rate into chamber 282*a*.

Still referring to FIG. 2, in one aspect, the sample clean-up unit 280 includes a fluid collection chamber 282 that contains a piston 284. The piston 284 divides the chamber 282 into a fluid collection side or fluid collection chamber 282*a* that is in fluid communication with line 268 and a back side or a back fluid chamber 282*b*. The back side 282*b* is filled with an incompressible or substantially incompressible fluid 286. In one aspect, the back side 282*b* is in pressure communication with a force application device 290 via a flow control device 288. The force application device 290, in one aspect, may include a piston 292 that divides a chamber 294 into a front side 294*a* and a back side 294*b*. The back side 294*b* is filled with a compressed gas 296, such as nitrogen. In one aspect, the flow control device 288 is a controllable device, such as controllable valve that is controlled to meter fluid 286 between chambers 282*b* and 294*a*. Controlling the flow of the fluid from chamber 282*b* to chamber 294*a* through the flow control device 288 maintains the back side of the piston 284 under desired pressure or force. The pressure in the chamber 294*b* is selected to avoid flashing of the fluid 112*b* being collected in chamber 282*a*, i.e. above the bubble point of such fluid. A flow control device 298 associated with chamber 294*b* may be utilized to fill the chamber 294*b* with a selected gas at a selected pressure.

The fluid present in the formation proximate to the wellbore is typically contaminated with the drilling fluid. The initial fluid extracted from the inner and outer probes 210 and 250 is thus contaminated fluid. Before clean fluid enters probes 210 and 250, the contaminated fluid entering the probes 210 and 250 is discarded into the wellbore 201. To discharge such fluid into the wellbore 201, flow control devices 220, 226, 256 and 262 are opened, while flow control devices 216, 222, 264, 266 and 270 are closed and pumps 230 and 240 are activated. Pump 230 extracts the formation fluid 211*a* from the inner probe 210 and such fluid is discharged into the wellbore 201 via flow control device 226, lines 232, 232*a*, 232*b*, 232*c*, 214 and flow control device 220. The fluid flow path for discharging the fluid 211*a* into the wellbore 201 is shown by arrows 215. Pump 240 extracts formation fluid 211*b* from formation 260, which is discharged into the wellbore 201 via fluid lines 242, 242*a*, 242*b*, 242*c*, 244 and flow control device 262. The fluid flow path of fluid 211*b* being discharged into the wellbore 201 is shown by arrows 225. The flow analysis device 285 provides measurements relating to the contamination level or contaminations in the fluid being extracted from the inner probe 210. A fluid analysis device 275 may be provided for determining characteristics of the fluid 211*b* flowing from the outer probe 250. The controllers 170 and/or 190 process the information from devices 275 and 285 and determine the contamination level. When the contamination level reaches an acceptable level or meets a threshold, the process of collecting clean sample is initiated as described in reference to FIGS. 3 and 4.

Figure 3:
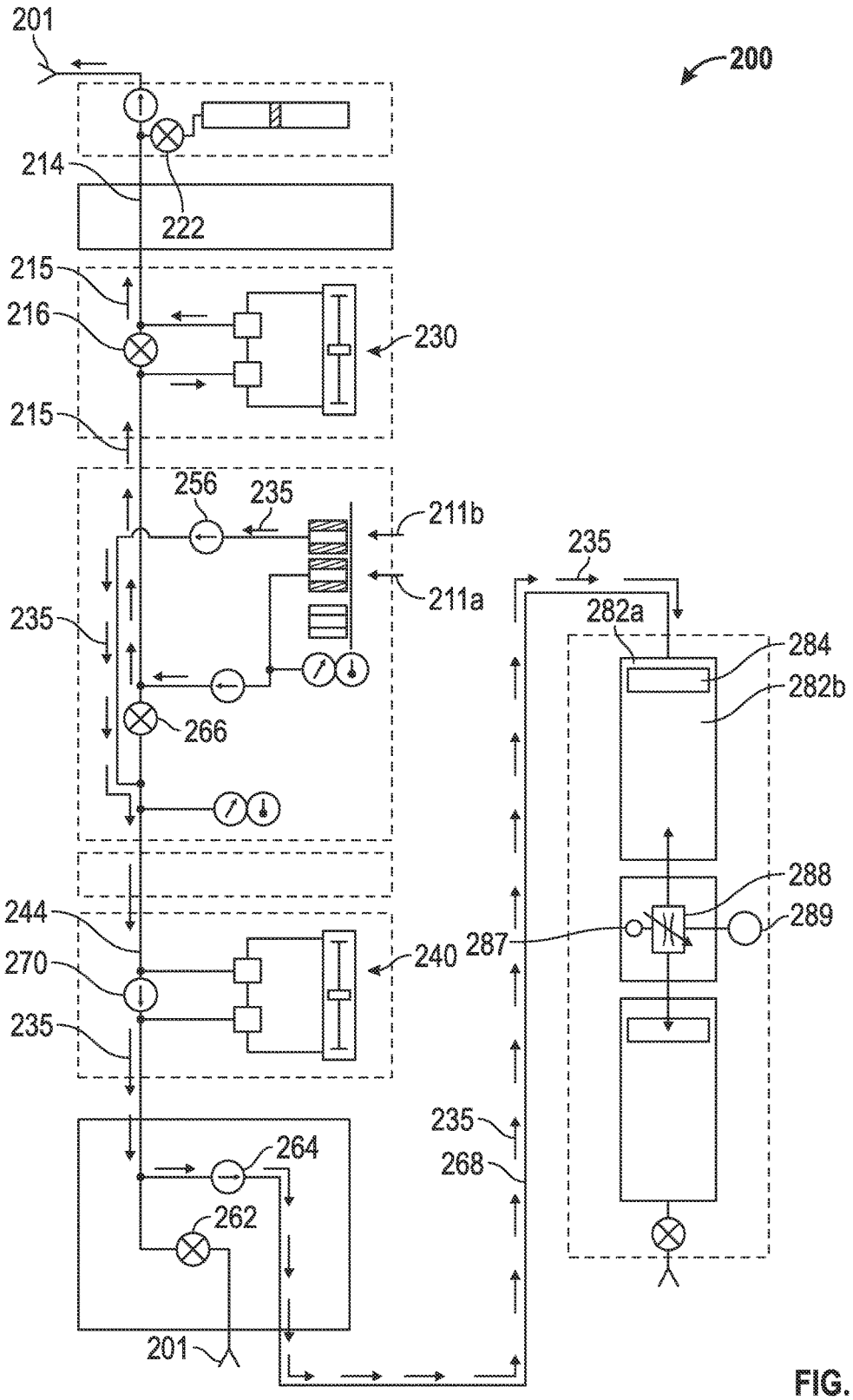
FIG. 3 is a line diagram of the formation evaluation tool of FIG. 2 that shows pumping of the formation fluid from the inner probe into the wellbore and initiating collection of the formation fluid from the outer probe into a sample clean-up unit without using a pump.
Figure 4:
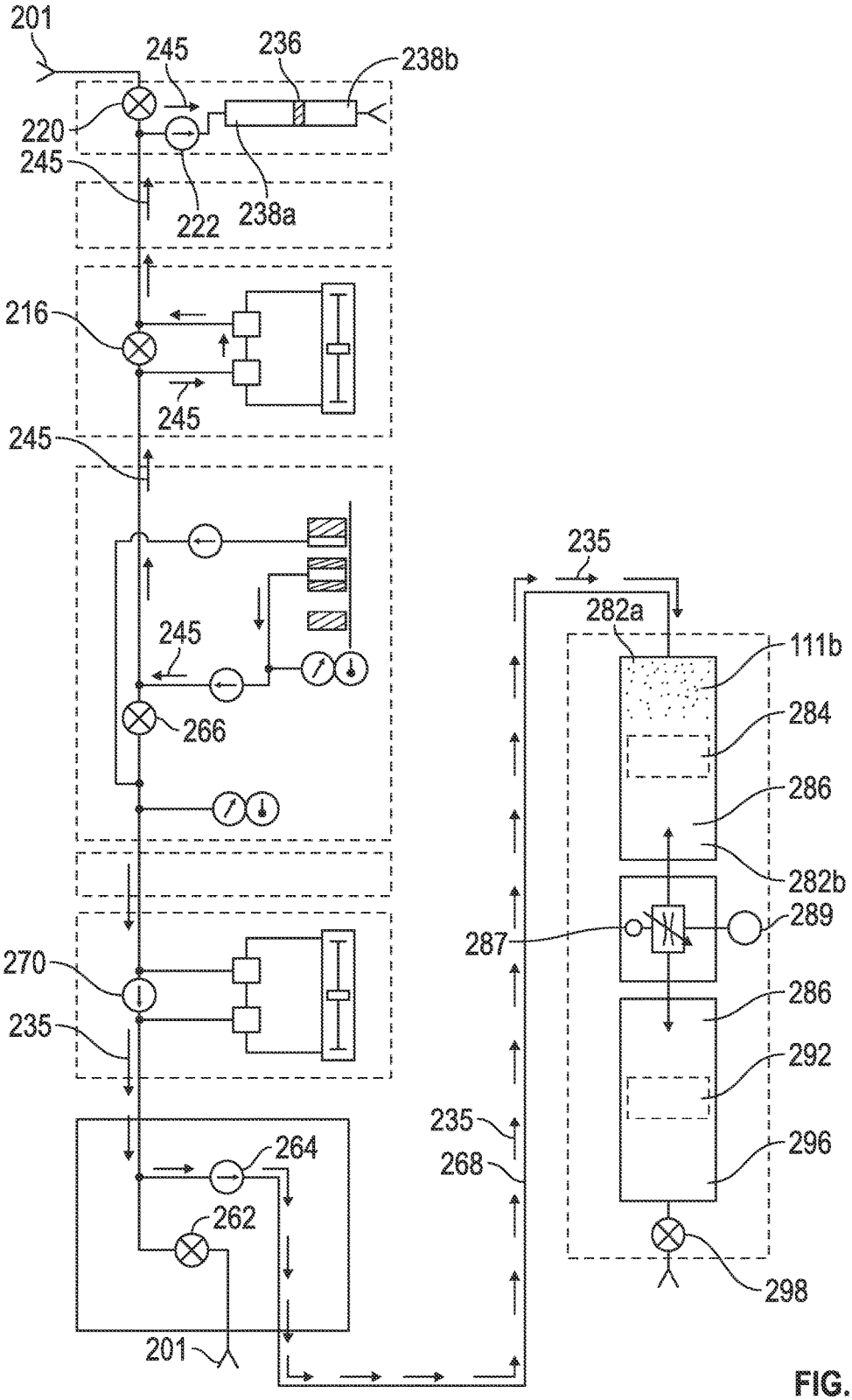
FIG. 4 is a line diagram of the formation evaluation tool of FIG. 2 that shows pumping of the clean formation fluid from the inner probe into the sample chamber and collecting the formation fluid from the outer probe into the sample clean-up unit.

FIG. 3 is a line diagram of the formation evaluation tool of FIG. 2 that shows initiating the collection of the formation fluid from the outer probe 250 into the sample clean-up unit 280. As shown in FIG. 3, pump 240 is deactivated, flow control device 262 is closed and the flow control devices 264 and 270 are opened. Pump 230 remains activated. In this configuration, the formation 260 and thus fluid 211*b* is in fluid communication with the chamber 284*a* via line 268, flow control device 256, line 244, flow control devices 270 and 264 and line 268. Since the pressure in chamber 282*a* is lower than the pressure of the formation 260, fluid 211*b* from formation 260 flows into chamber 282*a*. The control valve 288 is controlled or meter or control the flow of the fluid 211*b* into chamber 282*a*. The flow of the fluid 211*b* from the outer probe 250 into the chamber 282*a* is shown by arrows 235. Collection of a certain amount of the formation fluid from the outer probe into chamber 282*a* establishes a perimeter cleanup focused flow cone. FIG. 4 shows the collection of clean formation fluid 211*a* from probe 210 into sample chamber 236. To collect the clean sample, the flow control device 220 is closed and the flow control device is opened. The fluid 211*a* from probe 210 then pumped into the chamber 238*a* against a selected pressure applied by chamber 238*b*. The flow of the clean formation fluid into sample chamber 238*a* is shown by arrows 245. As discussed earlier, the fluid in sample chamber 238*a* is collected against a selected pressure above the bubble point of the fluid being collected. The fluid from the outer probe 250 continues to be collected in chamber 282*a* while the clean fluid 211*a* is being collected in the sample chamber 238*a*. As the fluid from the outer probe 250 is collected in chamber 282*a*, piston 284 moves in chamber 282, causing the fluid 286 to move into chamber 294*a*, which causes the piston 292 to move and compress the fluid 296. In this configuration, since pump 240 is inactive and the fluid in the chamber 284*a* of the sample clean-up unit 280 is collected using energy naturally present downhole, i.e., the pressure differential between the formation pressure and the pressure in chamber 282*a*, which conserves the energy produced by downhole tools. Additionally, since pump 240 is inactive, it does not cause any kick back to probes 210, 250 or formation 260 during collection of the clean sample. Also, typically a common hydraulic line is utilized to operate the various flow control devices and pumps 230 and 240. When pump 240 is deactivated, it enables increasing the rate of pump 230, which allows faster filling of the sample chamber 236. The rate of flow of fluid into chamber 282*a* is controlled by the flow control device 288. In one aspect, the flow control device may be a variable control valve, controlled by downhole control bit 170 and/or surface control unit 190 (FIG. 1). Once the sample of clean fluid has been collected, the sample cleanup unit may be reset for reuse downhole.

Figure 5:
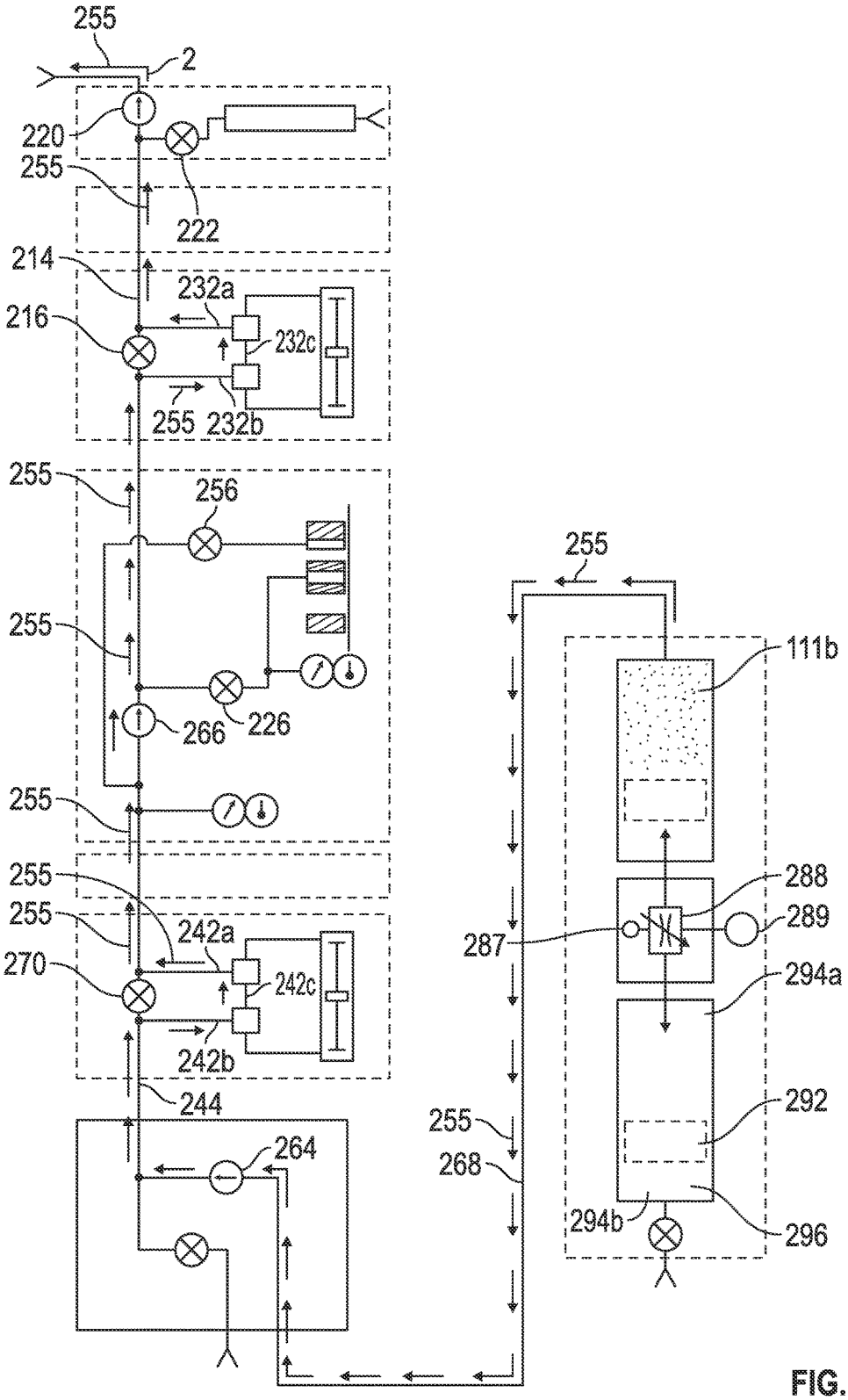
FIG. 5 is a line diagram of the formation evaluation tool of FIG. 2 that shows expelling the fluid from the sample-clean-up unit into the wellbore.
Figure 6:
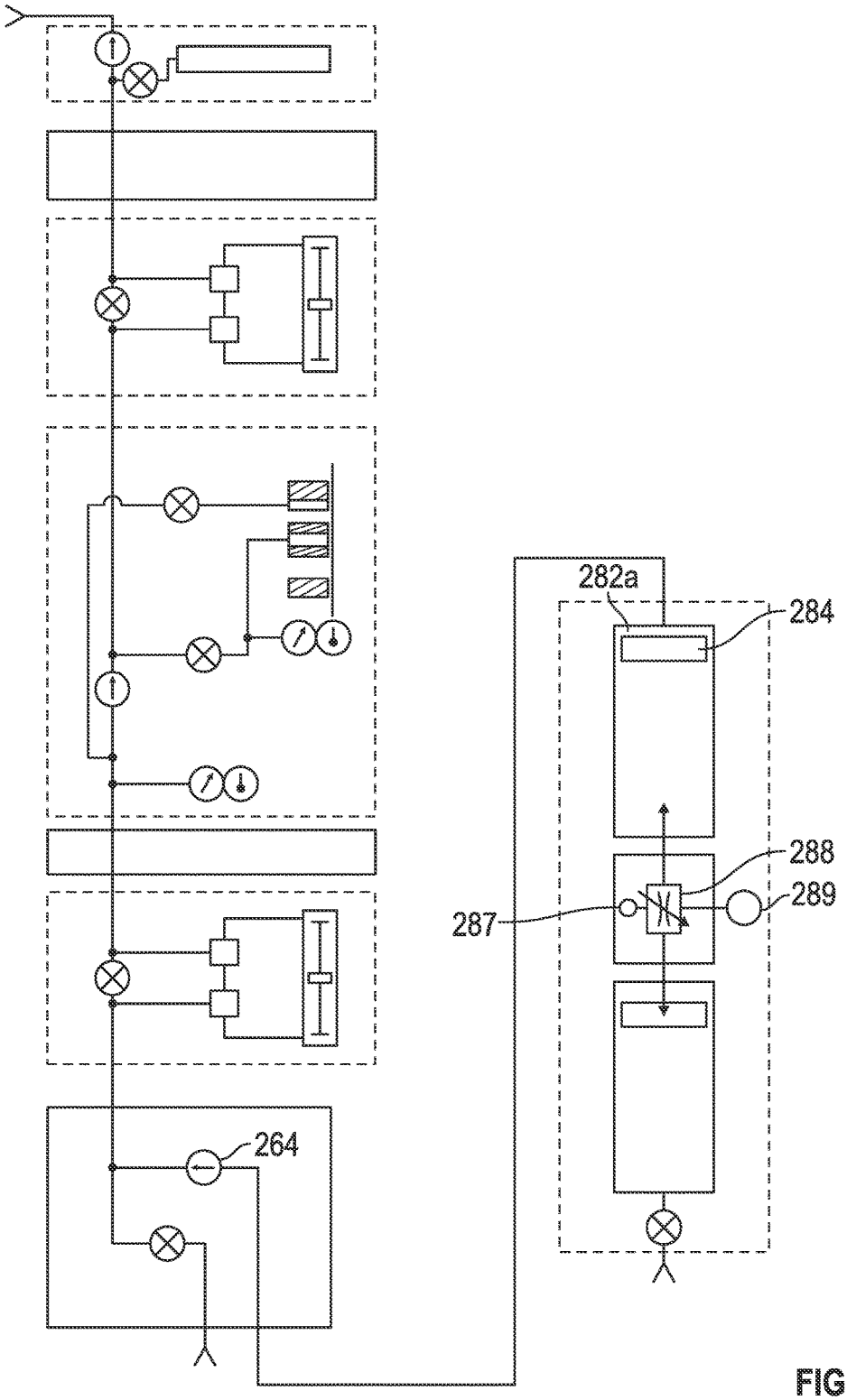
FIG. 6 is a line diagram of the formation evaluation tool of FIG. 2 that shows the formation fluid collected in the sample-clean-up unit has been expelled and it is ready for use without retrieving the tool from the wellbore.

FIGS. 5 and 6 show a manner of resetting the sample clean-up unit 280 for reuse downhole by expelling fluid in chamber 282*a*. To expel the fluid from chamber 282*a*, probes 210 and 250 may be retracted so that they are not in contact with the formation. Flow control devices 226, 256, 270 and 222 are closed while flow control devices 266 and 220 are opened. Pumps 230 and 240 are activated to pump the fluid from chamber 282*a* into the wellbore 260 via lines 268, flow control device 264, line 244, pump connections 242*a*, 242*b*, 242*c*, flow control device 266, pump connections 232*a*, 232*b*, 232*c*, line 214 and flow control device 220. The flow path for the fluid expelled from chamber 282*a* to the wellbore 201 is shown by arrows 255. As the fluid from chamber 282*a* is being expelled, fluid 296 expands causing piston 292 to move, which causes fluid in chamber 294*a* to move into chamber 282*b*, which then causes piston to 284 to move to its initial position shown in FIG. 2. When the fluid from chamber 282*a* has been expelled, flow control device 220 is closed. The tool 200 may then be utilized to obtain another sample at the same location or at another location in the wellbore 201. If desired, more than one sample clean-up device may be utilized or the size of chamber 282 may be chosen so multiple clean samples may be collected at the same or different wellbore locations. Also, only one pump may be used to expel fluid from chamber 282*a*.

Although, the above embodiments show two probes in a wireline tool, the clean-up unit 280 may equally be utilized with a tool having a single or multiple probes and in wireline tools and in tools utilized during drilling of wellbores, such as drilling assemblies or bottomhole assemblies. Additionally, one or more sample chambers and clean-up units may be utilized for the purpose of this disclosure.

While the foregoing disclosure is directed to the embodiments of the disclosure, various modifications will be apparent to those skilled in the art. It is intended that all variations within the scope and spirit of the appended claims be embraced by the foregoing disclosure.

The invention claimed is:

1. A method of obtaining a sample of a fluid from a formation surrounding a wellbore, comprising:

pumping formation fluid received by an inner probe from the formation into a sample chamber;

collecting formation fluid received by an outer probe from the formation into a fluid collection chamber having an internal pressure less than the pressure of the formation; and controlling the internal pressure of the fluid collection chamber to draw the formation fluid into the fluid collection chamber by flowing a fluid under pressure from the fluid collection chamber into a force application device via a flow control device.

2. The method of claim 1, wherein controlling the rate of flow of the formation fluid from the outer probe comprises controlling a valve in a fluid line to control the flow of the formation fluid from the outer probe into the fluid collection chamber.

3. The method of claim 1 further comprising determining when the formation fluid received by one of the inner and outer probes is clean by using an optical device to determine contamination in the formation fluid received by one of the inner and outer probes.

4. The method of claim 1, further comprising controlling the internal pressure of the fluid collection chamber by measuring the flow of the fluid under pressure at the flow control device.

5. The method of claim 1 further comprising expelling the formation fluid from the fluid collection chamber.

6. The method of claim 5 further comprising using at least two pumps for expelling the formation fluid from the fluid collection chamber and a common fluid line for discharging the extracted formation fluid into the wellbore.

7. The method of claim 1 further comprising controlling a rate of flow of the formation fluid from the outer probe into the fluid collection chamber by controlling the internal pressure.

8. The method of claim 7, wherein controlling the rate of flow of the formation fluid comprises receiving the formation fluid from the outer probe into the fluid collection chamber against a piston in the fluid collection chamber, wherein the piston is maintained under the internal pressure.

9. The method of claim 7, wherein a compressed gas in the force application device applies the internal pressure to the piston in the fluid collection chamber.

10. An apparatus for obtaining fluid from a formation, comprising:

an inner probe and an outer probe;

a pump configured to extract formation fluid from the formation via the inner probe;

a fluid collection chamber of a sample clean-up unit configured to receive formation fluid from the outer probe due to a pressure differential between the formation and the fluid collection chamber; and a flow control device configured to control the pressure differential to receive the formation fluid into the fluid collection chamber by flowing a fluid under pressure from the fluid collection chamber to a force application device of the sample clean-up unit.

11. The apparatus of claim 10, wherein a piston in the fluid collection chamber separates the fluid collection chamber into a fluid collection side for collecting the formation fluid and a back side in fluid communication with the flow control device and a piston in the force application device separates the force application device into a front side in fluid communication with the flow control device and a back side that includes a compressed gas.

* * * * *